United States Patent [19]

Kobler

[11] Patent Number: 4,748,911

[45] Date of Patent: Jun. 7, 1988

[54] PRINTING MACHINE PLATE CYLINDER WITH ADJUSTABLE LATERAL REGISTER ARRANGEMENT

[75] Inventor: Ingo Kobler, Anhausen, Fed. Rep. of Germany

[73] Assignee: M.A.N.Roland Druckmaschinen Aktiengesellschaft, Offenbach am Main, Fed. Rep. of Germany

[21] Appl. No.: 941,382

[22] Filed: Dec. 15, 1986

[30] Foreign Application Priority Data

Dec. 20, 1985 [DE] Fed. Rep. of Germany ..... 3545297

[51] Int. Cl.[4] ..... B41F 13/16

[52] U.S. Cl. ..... 101/378; 74/424.8 B; 101/415.1

[58] Field of Search ..... 101/378, 415.1; 74/424.8 B

[56] References Cited

U.S. PATENT DOCUMENTS

| | | | |
|---|---|---|---|
| 618,252 | 1/1899 | Meyrueis | 101/378 |
| 686,380 | 11/1901 | Ames | 101/378 |
| 1,650,206 | 11/1927 | Halliwell | 101/378 |
| 1,726,836 | 9/1929 | Jordhoy | 101/378 |
| 1,994,384 | 3/1935 | Bradshaw | 101/378 |
| 2,342,830 | 2/1944 | Bate | 74/424.8 B |
| 2,709,405 | 5/1955 | McWhorter | 101/378 |
| 2,859,657 | 11/1958 | Harker | 74/424.8 B |
| 3,631,801 | 1/1972 | Luehrs | 101/378 |
| 3,727,471 | 4/1973 | Botos | 74/424.8 B |
| 3,844,177 | 10/1974 | Bourassa | 74/424.8 B |

FOREIGN PATENT DOCUMENTS

| | | | |
|---|---|---|---|
| 311974 | 5/1919 | Fed. Rep. of Germany | 74/424.8 B |
| 3019595 | 9/1982 | Fed. Rep. of Germany . | |

*Primary Examiner*—Clyde I. Coughenour

*Attorney, Agent, or Firm*—Frishauf, Holtz, Goodman & Woodward

[57] ABSTRACT

To compensate for expansion and width of printed substrates, for example paper webs, when subjected to damping liquid, printing plates are located on the printing cylinder in axially shiftable adjusted position, so that register can be maintained. The register adjustment arrangement includes coupling elements (10, 13; 11, 14) engageable with an adjustment device (7, 12, 18) and engagement plates or pins (5, 6; 21, 22), the coupling device conjointly being moved by an externally engageable adjustment knob or nut by threaded engagement between the knob and nut, in which the thread coupling between an engagement plate or pin at an outermost plate is at a pitch which is higher than the thread engagement with the engagement pins or plates of a more inwardly placed printing plate. Upon rotation of the adjustment knob or nut, thus, the outermost plate will be moved axially farther than the inwardly moved plate, although both plates moving together. A single adjustment element may be used for plates on both sides of a median line of the cylinder, by forming the threaded arrangement on one side as a right-hand thread and on the other side of the median line, as left-hand thread, or vice versa.

8 Claims, 2 Drawing Sheets

PRINTING MACHINE PLATE CYLINDER WITH ADJUSTABLE LATERAL REGISTER ARRANGEMENT

The present invention relates to printing machines, and more particularly to plate cylinders on which a plurality of printing plates can be attached, positioned axially side-by-side, and especially to an arrangement to maintain lateral register by engaging the printing plates with register elements.

BACKGROUND

It has previously been proposed—see German Pat. No. 30 19 595—to form the ends of printing plates with recesses which are coupled to register plates or register pins. The printing plate ends are customarily located in axial grooves on the plate cylinder, and clamped therein. The register plates or pins, likewise, are located in the cylinder groove to engage with the recesses of the plates. For each one of the axially adjacent plates, at least one register pin or plate is provided.

THE INVENTION

It is an object to improve the registration of printed subject matter on a paper web by providing for axial adjustment of printing plates, which is simple and effective.

Briefly, it has been found that printing machines, and particularly those using an offset process including damping fluid, sometimes provide printed copy which is not in perfect register. Upon investigation, the problem was found to be the absorption of damping fluid by the paper, and hence change in width of the paper as it became damp. It was further found that this change in width can be different between printing stations or printing systems. For example, the width of a web can change increasing from a central position towards the outside, as damping fluid is absorbed.

Based on this discovery, an adjustable lateral register apparatus was provided so that the position of axially adjacent plates can be corrected to compensate for change in width of the paper on which printing is to be effected. In accordance with a feature of the invention, axially movable register adjustment devices are secured to an end face of a plate cylinder, and connected to a coupling means which couples the adjustment device to engagement pins, plates or the like which engage with register recesses in the plates. The adjustment device provides for conjoint movement of the engagement means, such as pins or plates, such that the axially outermost engagement means for engagement with the axially outermost plate is axially movable by a distance which is greater than the movement of the engagement means for an axially inwardly position plate.

In accordance with a preferred feature of the invention, the coupling means include a threaded engagement arrangement, such as a spindle and spindle nut, internal-external threaded engagement arrangements and the like, for each of the engagement means for the plates, and in which the pitch of the respective threaded arrangement differs, so that the pitch of the threaded arrangement for the outer plate is steeper than that for an inwardly positioned plate. Consequently, rotation of the threaded engagement arrangement over a predetermined rotary angle causes different axial movement of the respective register engagement pins or elements with the respective axially adjacent plates.

The arrangement has the advantage that the position of printing plates adjacent each other can be automatically adjusted to, appropriately, compensate for changes in width of a printed substrate web, with the outermost one of the plates being moved for a greater distance than a plate inwardly thereof with one simple adjustment.

DRAWINGS

DETAILED DESCRIPTION

Figure 2:
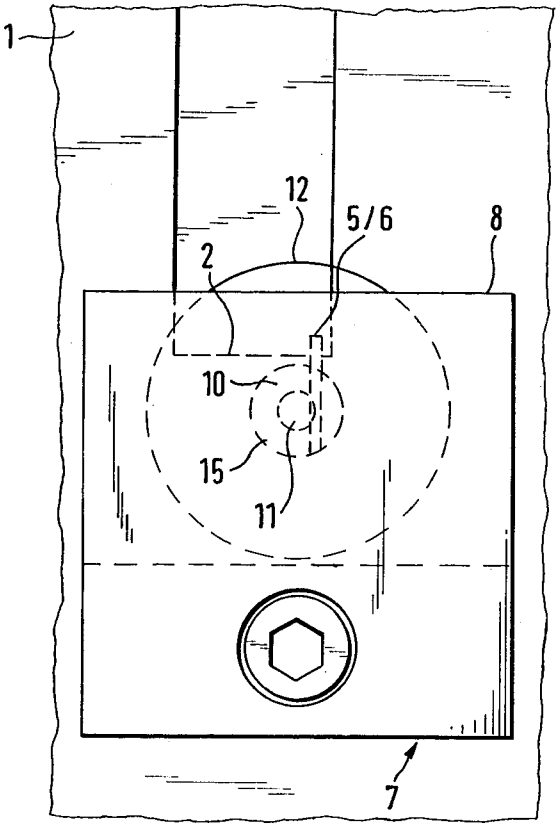
FIG. 2 is a side view thereof.
Figure 1:
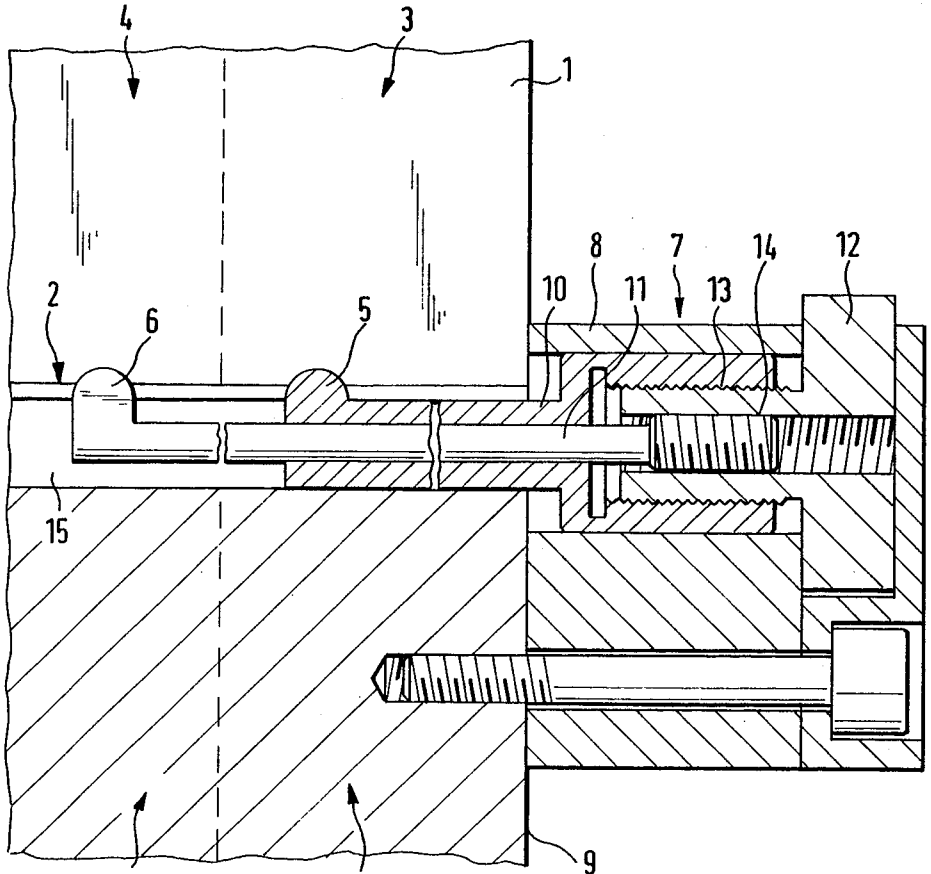
FIG. 1 is a fragmentary axial section through a plate cylinder, and illustrating the adjustment arrangement.

Only the right side of a plate cylinder 1 is shown in FIG. 1. The plate cylinder 1 has the customary cylinder groove 2, with suitable attachment elements to secure a plurality of printing plates 3, 4 axially adjacent each other. The attachment elements are conventional and are not shown in the drawing. Such a plate cylinder may have, for example, four printing plates, similar to plates 3, 4, secured thereto. The end portions of the plates are formed with register recesses or notches, into which a register pin or register plate 5, 6, respectively, can be engaged. The ends of the plates 3, 4 are located in predetermined positions within the cylinder groove.

In accordance with a feature of the invention, the register pins or plates, in short the register elements 5, 6, associated with the respective plates 3, 4 are moved conjointly and together by a lateral adjustment arrangement 7, in order to compensate for change in width of the web on which printed material is to be applied, for example due to acceptance of dampness from a damper. Thus, the lateral register elements 5, 6 position the plates 3, 4 to compensate for such width changes. The lateral register arrangement 7, preferably, is located on the end facing surface 9 of the cylinder, retained within a housing or frame 8, and attached to the cylinder 1 by suitable screws, of which only one is shown.

The lateral register of the plates 3, 4 is generated by axial movement of the engagement elements 5, 6 with the matching recesses of the plates. In accordance with a feature of the invention, an axial bore 15 is formed in the cylinder connected to communicating passages to the groove 2 of the cylinder. A tubular element 10 is located in the bore 15 receiving, in telescoping arrangement, a rod 11. The tubular element 10 and the rod element 11 are coupled, respectively, to the register elements 5, 6. The register elements 5, 6 and the positioning elements formed by the tube and rod 10, 11, can be unitary or connected together. Unitary construction is suitable if, for example, to facilitate introduction into the bore 15, a continuous slit-shaped passage is provided. Alternatively, the groove 2 can be enlarged or suitably shaped to receive the register adjustment elements 5–10 and 6–11.

The tubular element 10 receives the rod element 11. At the end portions of the positioning elements 10, 11, threads with different pitch are formed. To permit the bore 15, or similar space within the groove, to be small, the positioning elements 10, 11 are preferably enlarged outside of the cylinder by attaching suitable engagement elements, for example by welding or screwing enlarged adjustment elements to the rod or tube elements, respectively. The outer, tubular element 10 is formed with an inner thread positioned outside of the plate cylinder 1. The inner adjustment rod element 11 is formed with an outer thread. In accordance with a feature of the invention, the pitch of the thread differs. An engagement or adjustment screw 12, which is manually accessible—or which can be operated by a servo motor—includes an inner thread 14 engaging the outer thread on the rod 11 and an outer thread 13 engaging the inner thread on the element 10. The threads 13, 14, likewise, have different pitch.

Operation: Upon rotating the adjustment knob or nut 12 in either direction, the positioning elements 10, 11 are shifted in respective either axial direction over different path lengths. In accordance with a feature of the invention, the width or extension of the web, laterally, is thereby compensated. The outer plate 3 is shifted to a greater extent than the inner plate 4. Suitably, the thread 13 can be a standard metric M 10×1 thread; the thread 14 a standard metric M 5×0.5.

More than two plates can be located axially adjacent each other. If a center plate is used, it need not be shifted. The arrangement permits movement of two or more plates in common, or conjointly, but over different path lengths for each angular increment of revolution of the adjustment nut or knob 12.

A similar lateral adjustment arrangement 7 can be located at the other end face of the cylinder so that, starting from the center of the cylinder, both leftmost plates can be adjusted in the same manner as the two rightmost plates. The housing plate 8, engaging over the knob or nut 12, holds the nut 12 in adjusted position.

Figure 3:
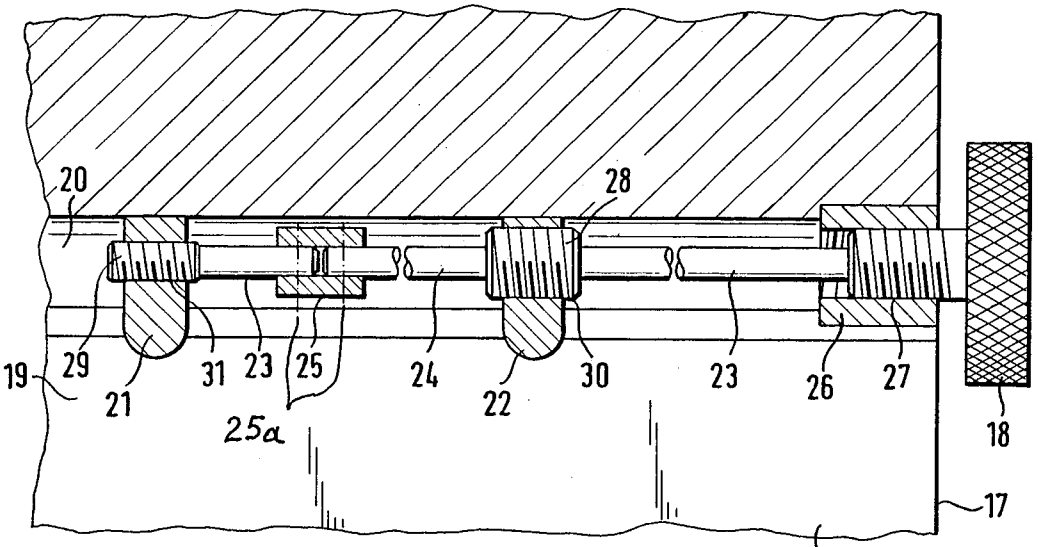
FIG. 3 is a view similar to FIG. 1 and illustrating another embodiment of the lateral register control arrangement.

Embodiment of FIG. 3: A plate cylinder 16 has a plurality of printing plates located thereon, not differentiated specially. An adjustment knob or nut 18 is located adjacent a facing end surface 17 of the cylinder 16. The knob 18 is coupled to a rod and formed with a bushing. A recess or a bore 20, as desired, is located in the clyinder groove or adjacent the cylinder groove 19, from which register elements 21, 22, in plate form, extend for engagement with suitable recesses in the printing plates. The register plates 21, 22 are coupled together by adjustment spindles 23, 24 located in the respective bore or recess 20. After first adjusting the position of the register plates, a coupling element 25 is connected by suitable set screws or coupling pins shown schematically at 25*a*. A similar coupling element may also be used at the right side of the register element 22, although, for most purposes, it is sufficient if the register element 22 is fixed to the rod 23, coupled to the adjustment knob 18.

The rightmost spindle 23 is secured to the knob 18 which is threaded in a threaded bushing 26 by a thread 27.

Each one of the register elements 21, 22, with the respective associated spindles 23, 24, is coupled to the spindle by a thread element 28, 29 which is, preferably, located on the respective portion of the spindle 23, 24. In accordance with a feature of the invention, the thread elements 28, 29 are threaded with different pitch. In a preferred embodiment, the following threads and pitch relations may be suitable, all threads being given in metric thread notation:

Thread element 26: M 12×0.5
thread element 30: M 12×1.25
thread element 31: M 6×0.75..

Upon rotation of the adjustment knob 18 by 180°, axial shift of the register element 21 will be 0.125 mm and of the register element 22 0.375 mm.

The arrangement of FIG. 3 has the advantage that only a single adjustment knob is needed to adjust, also, the position of threaded elements to the left of the center line of the cylinder 16, by extending the spindle 23 towards the left. The pitches above described can also be used for such an extension, with the difference, however, that the direction of rise of the respective threads at the left side is reversed. For example, the thread elements 28, 29 may have right-hand threads, and thread elements to the left of the center line of the cylinder 16 then will have left-hand threads—or vice versa.

Various changes and modifications may be made within the scope of the invention concept, and features described in connection with any one of the embodiments may be used with any of the others.

I claim:

1. The combination of an offset printing machine plate cylinder (1, 16) with means for compensation for dimensional change due to absorption of damping fluid by a paper web, upon offset printing on the web, comprising a lateral printing plate register arrangement for conjointly adjusting the axial register of a plurality of printing plates (3, 4) positioned axially adjacent each other on the plate cylinder (1), wherein the printing plates are formed with end portions, each formed with at least one protruding portion having therein an end register recess, and wherein the plate cylinder (1, 16) is formed with an axial groove (2), the end portions of the plurality of printing plates (3, 4) being located in said groove axially adjacent each other, and retained therein, and wherein the register arrangement comprises register means (5, 6; 21, 22) located in the groove of the cylinder and individually engageable in the end recesses of the plates;

a rotatable, adjustable, axial register adjustment device (7, 12, 18) secured to an end face (9, 17) of the plate cylinder (1, 16) conjointly acting on said plurality of axially adjacent plates;

coupling means (10, 13; 11, 14; 23, 24, 28, 30, 29, 31) including an axial spindle, coupling said adjustment device to the register means (5, 6; 21, 22) in said groove for conjoint movement in either direction by said register means in engagement with the respective plates, said coupling means comprising a threaded engagement arrangement for each said register means with respectively different pitch of thread engagement associated with the outermost and the axially inwardly positioned register means to move the axially outermost register means (5, 22) axially by a distance which is greater than the axial movement of the register means (6, 21) positioned axially inwardly of the outermost engagement region upon rotation of the spindle;

wherein the groove is formed with a recess retaining said coupling means; and said register means (5, 6) include engagement elements extending from said recess into the groove for engagement with the respective at least one end register recess of the printing plates (3, 4).

2. The arrangement of claim 1, wherein the adjustment device and the coupling means comprise an externally adjustable rotatable knob or nut (18);

the spindle (23, 24) being coupled to the nut;

and spindle nuts (30, 31) respectively coupled to the spindle, and threaded on the spindle, the threads of the spindle nuts and of the spindle associated with the register means (21, 22) for respectively adjacent plates having different pitch, the pitch of the threads (30, 31) increasing from a center region of the cylinder towards outermost region thereof.

3. The arrangement of claim 2, wherein the spindle comprises spindle portions (23, 24) and adjustment and coupling elements (25), the spindle portions being located between the spindle nuts coupled to the respective engagement means;

and wherein the adjustment knob or nut (18) is coupled to an adjustment screw (27) threaded into the side wall (17) of the cylinder (16).

4. The arrangement of claim 3, wherein threaded engagement arrangement for the register means are provided at respectively opposite sides of the cylinders and include, respectively, right-hand threads and left-hand threads at opposite sides of the cylinder, with respect to a center line thereof so that, upon rotation of the axial register adjustment device in one direction, the movement of the respective engagement means for the plates at opposite sides of the center line of the cylinder will be in opposite directions.

5. The arrangement of claim 2, wherein threaded engagement arrangement for the register means are provided at respectively opposite sides of the cylinders and include, respectively, right-hand threads and left-hand threads at opposite sides of the cylinder, with respect to a center line thereof so that, upon rotation of the axial register adjustment device in one direction, the movement of the respective engagement means for the plates at opposite sides of the center line of the cylinder will be in opposite directions.

6. The arrangement of claim 1, wherein the threaded engagement arrangement for the register means are provided at respectively opposite sides of the cylinders and include, respectively, right-hand threads and left-hand threads at opposite sides of the cylinder, with respect to a center line thereof so that, upon rotation of the axial register adjustment device in one direction, the movement of the respective engagement means for the plates at opposite sides of the center line of the cylinder will be in opposite directions.

7. The arrangement of claim 1, wherein the coupling means comprises telescopically arranged coupling elements (10, 11), including an outer tubular element (10) and an inner element (11), the outer element being formed with an inner thread, and the inner element being formed with an outer thread;

and wherein the movable adjustment device comprises a hollow adjustment bushing or sleeve formed with an outer and inner thread, the outer thread of the sleeve engaging the inner thread of the tubular element, and the inner thread of the sleeve engaging the outer thread of the inner element (11), and an external adjustment knob or nut coupled to said sleeve.

8. The arrangement of claim 7, further including a housing element (8) overlapping said adjustment knob or nut, and retaining said nut in position on the plate cylinder (1).

* * * * *